US008622507B2

(12) United States Patent
Inomata

(10) Patent No.: US 8,622,507 B2
(45) Date of Patent: Jan. 7, 2014

(54) CONTROL METHOD FOR A FLUID EJECTION DEVICE, AND A FLUID EJECTION DEVICE

(75) Inventor: Satoshi Inomata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 243 days.

(21) Appl. No.: 13/071,432

(22) Filed: Mar. 24, 2011

(65) Prior Publication Data

US 2011/0234694 A1 Sep. 29, 2011

(30) Foreign Application Priority Data

Mar. 25, 2010 (JP) ..... 2010-071028

(51) Int. Cl.
*B41J 2/165* (2006.01)

(52) U.S. Cl.
USPC ..... 347/22; 347/33; 347/30; 347/19; 347/23

(58) Field of Classification Search
USPC ..... 347/33, 30, 22, 23, 29, 34, 19
See application file for complete search history.

(56) References Cited

U.S. PATENT DOCUMENTS 7,328,962 B2 2/2008 Higuchi et al.

FOREIGN PATENT DOCUMENTS

| | | | |
|---|---|---|---|
| JP | 2004-291473 A | | 10/2004 |
| JP | 2009-190282 A | | 8/2009 |
| JP | 2010-030185 | * | 2/2010 |
| JP | 2010-030185 A | | 2/2010 |

* cited by examiner

*Primary Examiner* — Henok Legesse
(74) *Attorney, Agent, or Firm* — Kilpatrick Townsend & Stockton LLP

(57) ABSTRACT

A control method for a fluid ejection device and a fluid ejection device reliably eliminate dropped dots while reducing consumption of ink droplets ejected from the nozzles. A fluid ejection device that performs at least one of a cleaning operation that suctions fluid from the nozzles and a wiping operation that wipes the nozzle surface when dropped dots occur determines if an elimination history of removing dropped dots by the wiping operation is stored when dropped dots are detected as a result of testing for dropped dots and determining if dropped dots occur. When a history of eliminating dropped dots by means of a wiping operation is not stored, the fluid ejection device performs the wiping operation. When a history of eliminating dropped dots by means of a wiping operation remains in memory, the cleaning operation is performed without the wiping operation.

10 Claims, 6 Drawing Sheets

FIG. 4A
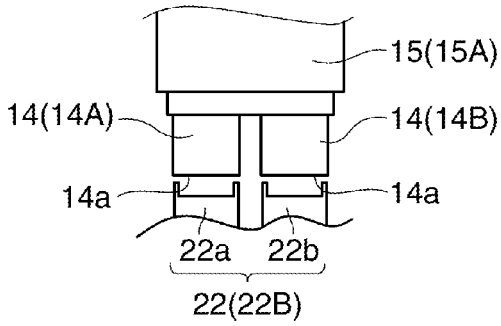
FIG. 4B
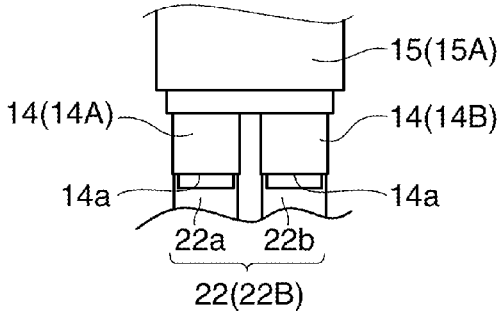
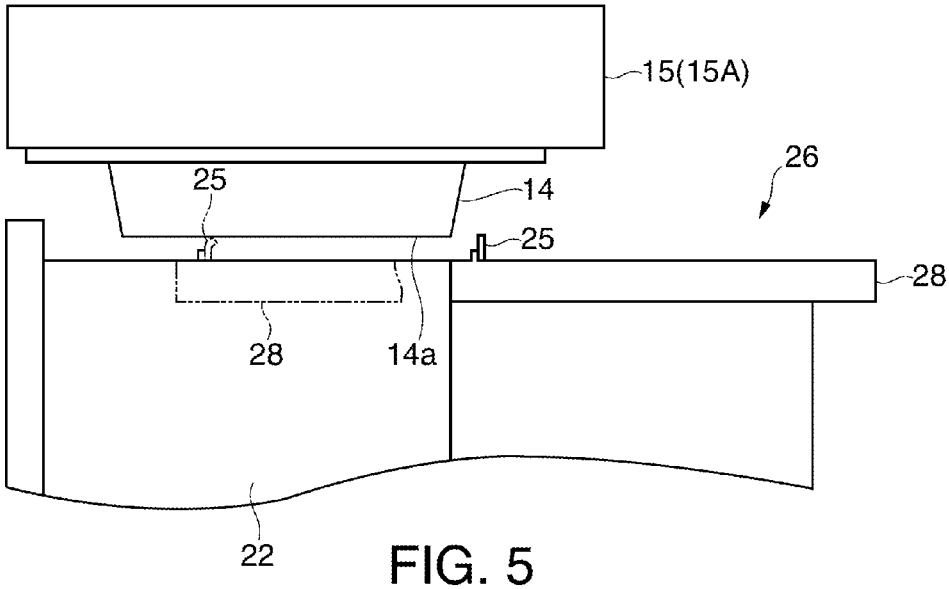
FIG. 5

CONTROL METHOD FOR A FLUID EJECTION DEVICE, AND A FLUID EJECTION DEVICE

This application claims priority to Japanese Patent Application No. 2010-071028, filed Mar. 25, 2010, the entirety of which is incorporated by reference herein.

BACKGROUND

1. Technical Field

The present invention relates to control method for a fluid ejection device having a fluid ejection head with a plurality of nozzles for discharging a fluid, and to the fluid ejection device.

2. Related Art

Inkjet printers have a printhead with a plurality of nozzles that discharge ink droplets, and the printhead is mounted on a carriage with the nozzle surface where the plural nozzles are arranged facing down. Inkjet printers that have a head maintenance mechanism for maintaining the printhead exposed below the carriage are also known from the literature. See, for example, Japanese Unexamined Patent Appl. Pub. JP-A-2009-190282.

The head maintenance mechanism of the inkjet printer taught in JP-A-2009-190282 includes a wiper mechanism that physically wipes the nozzle surface, and an ink suction mechanism that suctions ink from the nozzles. The head maintenance mechanism also functions as an ink droplet ejection test device that checks if ink droplets are ejected from the plural nozzles normally (that is, checks to find any clogged nozzles). The head maintenance mechanism checks whether or not ink droplets are ejected from the plural nozzles based on a current change that occurs when charged ink discharged from the nozzles lands on a sponge (absorbent material) disposed inside the head maintenance mechanism.

The inkjet printer taught in JP-A-2009-190282 runs the ink droplet ejection test of the ink droplet ejection test device every time after a predetermined number of pages have been printed. If dropped dots resulting from a nozzle not discharging ink are confirmed by the ink droplet ejection test, an operation to eliminate the dropped dots is performed. Operations to eliminate dropped dots may include, for example, a cleaning operation that suctions ink from the nozzles by means of the ink suction mechanism, and a wiping operation that wipes the nozzle surface by means of the wiper mechanism. Because the cleaning operation suctions ink from the nozzle surface, dropped dots can be reliably eliminated by running the cleaning operation when dropped dots are confirmed, but this increases ink consumption. On the other hand, because the wiping operation does not suction ink, dropped dots can be eliminated while reducing ink consumption if the wiping operation is performed when dropped dots are confirmed.

However, our studies have confirmed that the following problem can result when dropped dots are eliminated using the wiping operation. More specifically, our tests showed that ink can be forced into a nozzle by the wiping operation without the wiping operation actually eliminating the dropped dots, and this ink can then discharged from the nozzle in the ink droplet ejection test. As a result, the ink droplet ejection test falsely indicates that the dropped dots were eliminated even though they were not actually eliminated. When printing then proceeds, dropped dots reappear in the printed output because the faulty nozzles were not actually restored and the dropped dots were not actually eliminated.

SUMMARY

A control method for a fluid ejection device and a fluid ejection device according to the invention reliably eliminate dropped dots while reducing consumption of ink droplets ejected from the nozzles.

A first aspect of the invention is a control method for a fluid ejection device that performs at least one of a cleaning operation that suctions fluid from a nozzle and a wiping operation that wipes the nozzle surface in which a plurality of nozzles are disposed when dropped dots result from one or more of a plurality of nozzles for ejecting fluid not ejecting fluid droplets, comprising: a dropped dot detection step that tests for dropped dots and determines if dropped dots occur; an elimination history detection step that, when the dropped dot detection step determines there are dropped dots, determines if a history of eliminating dropped dots by means of a wiping operation remains; a wiping step that performs the wiping operation when the elimination history detection step determines the elimination history does not remain; and a cleaning step that performs the cleaning operation without performing the wiping operation when the elimination history detection step determines the elimination history remains.

When dropped dots are detected, the control method of a fluid ejection device according to this aspect of the invention performs a wiping operation if an elimination history indicating that dropped dots were removed by a wiping operation that wipes the nozzle surface with a wiper does not remain in memory. As a result, dropped dots can be eliminated and consumption of fluid droplets discharged from the nozzles can be reduced by using a wiping operation.

However, if a history of eliminating dropped dots by means of a wiping operation remains in memory, the wiping operation is not performed and a cleaning operation that suctions fluid from the nozzles is performed. As a result, if dropped dots occur even though the wiping operation was performed to eliminate dropped dots, the dropped dots can be reliably eliminated and the problem resulting from the wiping operation as described above can be solved.

A control method for a fluid ejection device according to another aspect of the invention preferably has a second dropped dot detection step that tests for dropped dots and determines if dropped dots occur after the wiping step, and performs the cleaning operation if the second dropped dot detection step determines dropped dots have not been eliminated.

With this aspect of the invention the cleaning operation is performed if the dropped dots are not eliminated by the wiping operation in the wiping step. Dropped dots can therefore be reliably eliminated by the cleaning operation.

A control method for a fluid ejection device according to another aspect of the invention preferably has a second dropped dot detection step that tests for dropped dots and determines if dropped dots occur after the wiping step; and a set dropped dot elimination flag step that sets a dropped dot elimination flag when the second dropped dot detection step determines that dropped dots were eliminated. With this configuration, the next time that dropped dots occur, the elimination history detection step determines whether or not the elimination history remains by determining if the dropped dot elimination flag is set.

A control method for a fluid ejection device according to another aspect of the invention preferably also has a reset dropped dot elimination flag step that resets the dropped dot elimination flag when the elimination history detection step determines that the dropped dot elimination flag is set, and executes the cleaning step after the reset dropped dot elimination flag step.

This aspect of the invention resets the dropped dot elimination flag before the cleaning step.

A control method for a fluid ejection device according to another aspect of the invention preferably also has a second reset dropped dot elimination flag step that resets the dropped dot elimination flag when the dropped dot detection step determines there are no dropped dots.

With this aspect of the invention the wiping operation is first performed the next time dropped dots are detected when dropped dots were actually eliminated by the wiping operation the last time dropped dots were detected. Compared with a configuration in which the cleaning operation is performed instead of the wiping operation because a history of eliminating dropped dots by means of a wiping operation remains in memory even though the dropped dots were actually eliminated by a wiping operation, this aspect of the invention can reduce consumption of fluid droplets ejected from the nozzles.

Another aspect of the invention is a fluid ejection device including: a fluid ejection head having a plurality of nozzles for ejecting fluid droplets; a fluid droplet ejection test mechanism that tests for the presence of dropped dots caused by one or more of the plurality of nozzles not ejecting fluid droplets; a suction mechanism that suctions fluid from the nozzles; a wiping mechanism that wipes the nozzle surface of the fluid ejection head in which a plurality of the nozzles are disposed; a storage unit that can store a history of eliminating dropped dots by a wiping operation of the wiping mechanism; and a head maintenance unit control unit that determines if the dropped dot elimination history remains in the storage unit, and when dropped dots are detected drives the wiping mechanism if the elimination history does not remain in the storage unit, and drives the suction mechanism if the elimination history remains in the storage unit.

The storage unit in the fluid ejection device according to this aspect of the invention can store an elimination history of removing dropped dots by means of a wiping operation. When dropped dots are detected, the drive mechanism drives the wiping mechanism if a history of eliminating dropped dots by means of a wiping operation does not remain. Dropped dots can therefore be eliminated while reducing consumption of fluid droplets ejected from the nozzles.

However, if a history of eliminating dropped dots by means of a wiping operation remains in the storage unit, the drive mechanism drives the suction mechanism. Problems resulting from a wiping operation can therefore be solved and dropped dots can be reliably eliminated even when a wiping operation is also used to eliminate dropped dots.

In a fluid ejection device according to another aspect of the invention, the head maintenance unit control unit performs a second dropped dot detection operation that causes the fluid droplet ejection test mechanism to test for dropped dots after the wiping operation is performed and determine if dropped dots were eliminated by the wiping operation, and if dropped dots were not eliminated causes the suction mechanism to perform the cleaning operation. If elimination of dropped dots is confirmed, the head maintenance unit control unit sets the dropped dot elimination flag in the storage unit.

In a fluid ejection device according to another aspect of the invention, when the dropped dot elimination flag is set, the head maintenance unit control unit resets the dropped dot elimination flag, and after resetting the dropped dot elimination flag causes the suction mechanism to perform the cleaning operation.

In a fluid ejection device according to another aspect of the invention, the fluid ejection head is an inkjet head having a plurality of nozzles for ejecting ink. A fluid ejection device having an inkjet head according to this aspect of the invention can reliably eliminate dropped dots while reducing consumption of ink droplets ejected from the nozzles.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4A shows the relationship between the inkjet head and the head cap during the flushing operation, and FIG. 4B shows the relationship between the inkjet head and the head cap during the ink suction operation.

FIG. 5 shows the relationship between the inkjet head and the head wiper during the wiping operation.

DESCRIPTION OF EMBODIMENTS

An inkjet printer as an example of a fluid ejection device according to the invention, and a cleaning control method for an inkjet head according to a preferred embodiment of the invention are described below with reference to the accompanying figures.

General Configuration of an Inkjet Printer

Figure 1:
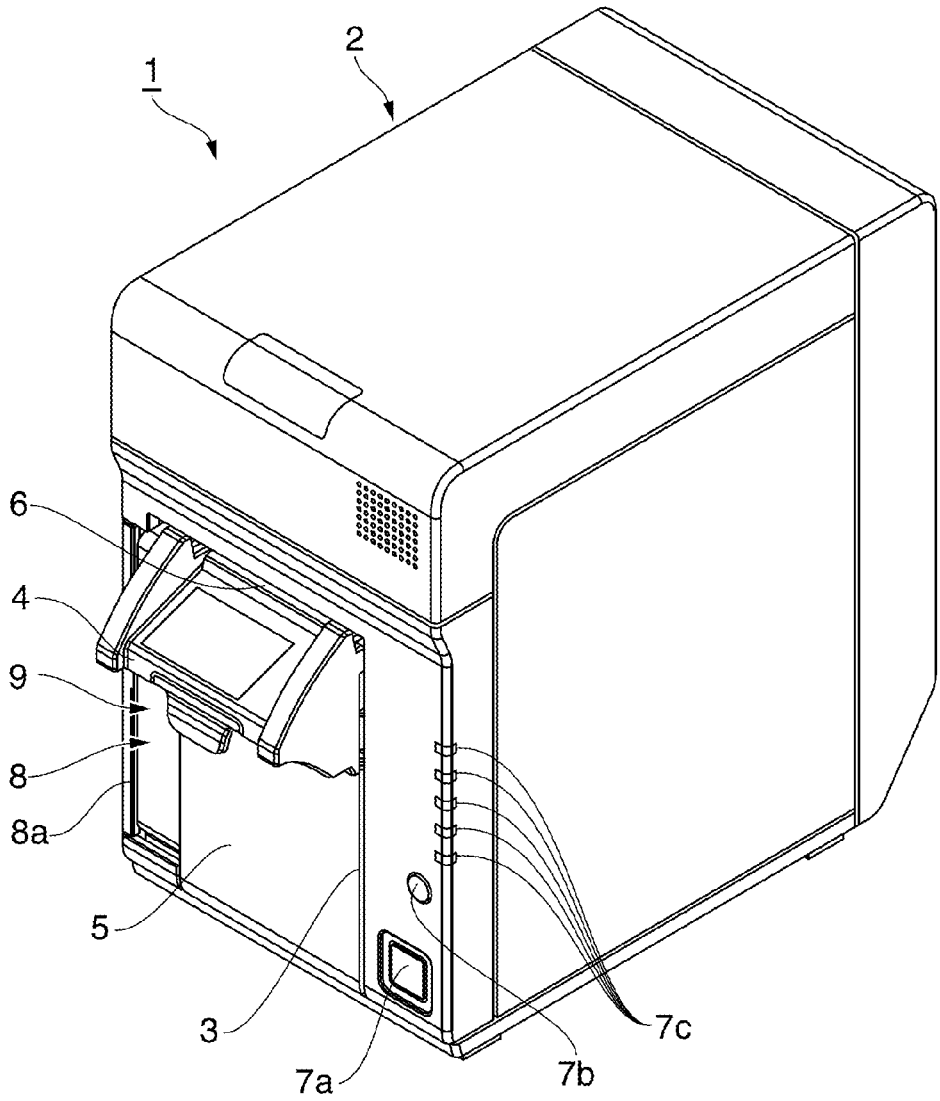
FIG. 1 is an external oblique view of an inkjet printer according to the invention.
Figure 2:
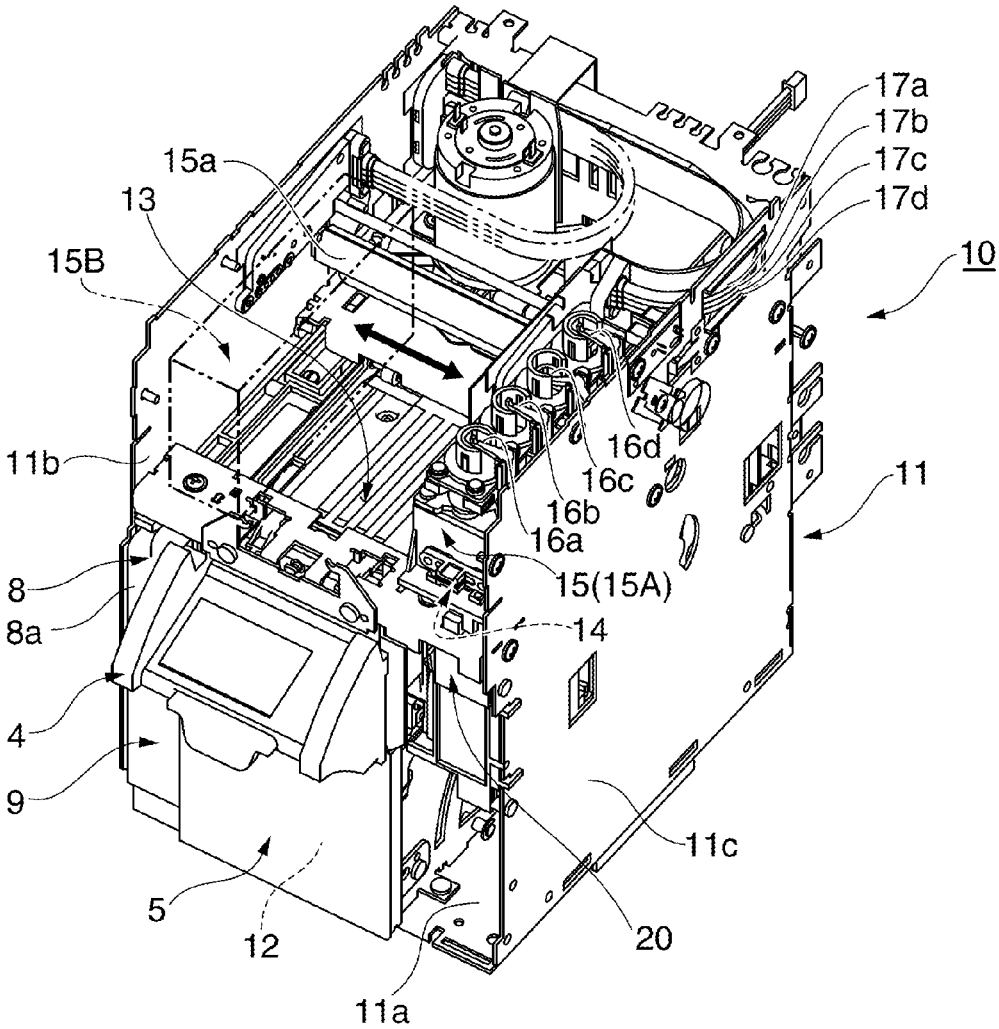
FIG. 2 is a schematic oblique view of the printer mechanism in the inkjet printer.

FIG. 1 is an external oblique view of an inkjet printer 1 according to a preferred embodiment of the invention. FIG. 2 is an oblique view of the print mechanism unit 10 that is covered by the printer case 2 of the inkjet printer 1.

The inkjet printer 1 prints in color on a continuous web of recording paper delivered from a paper roll using plural different colors of ink, and has a generally box-shaped printer case 2 with an opening 3 for loading roll paper formed in the front center part of the printer case 2. The opening 3 is closed by an access cover 5 to which a recording paper discharge guide 4 is disposed at the top. A recording paper exit 6 is formed between the recording paper discharge guide 4 and the top edge part of the opening 3 in the printer case 2. When a lock mechanism not shown is released and the recording paper discharge guide 4 is pulled forward by hand, the access cover 5 can pivot forward at the bottom end thereof from the closed position shown in the figure to an open position.

A power switch 7*a*, paper feed switch 7*b*, and a plurality of operating status indicators 7*c* are arrayed at the right side of the access cover 5 at the front of the printer case 2. A loading opening 8*a* for an ink cartridge loading unit 8 that is rectangular in section and is disposed with the long side extending in the front-back direction of the printer is formed in the front of the printer case 2 on the left side of the access cover 5, and an ink cartridge 9 is loaded in this ink cartridge loading unit 8.

When a button not shown is operated, the lock is released, the ink cartridge 9 is pushed forward by the force of a spring, and the ink cartridge 9 can be removed.

The print mechanism unit 10 disposed inside the printer case 2 has a printer frame 11 composed of a metal bottom 11*a* and left and right side panels 11*b*, 11*c* as shown in FIG. 2. A roll paper storage compartment 12 is formed in the middle at the front of the printer inside the printer frame 11. When an access cover 5 is opened, this roll paper storage compartment 12 opens to the front and the roll paper can be replaced, for example.

A platen 13 extends horizontally widthwise to the printer above the roll paper compartment 12. An inkjet head (fluid ejection head) 14 having a plurality of nozzles (ink nozzles) for ejecting ink droplets (fluid droplets) is disposed above the platen 13. The inkjet head 14 is mounted on a carriage 15 with the nozzle surface 14*a* in which the plural ink nozzles are arranged facing down.

The carriage 15 can move bidirectionally widthwise to the printer along a carriage guide shaft 15*a* extending horizontally widthwise to the printer. More specifically, the carriage 15 can move between a home position 15A that is removed to the right of the platen 13 and is indicated by a solid line in FIG. 2, and a left-end position 15B that is removed to the left side of the platen 13 and is indicated by a double dot-dash line in FIG. 2. A drive mechanism including a motor and a transmission mechanism such as a belt and pulleys is connected to the carriage 15.

Ink pumps for color ink, such as ink pumps 16*a* to 16*d* storing four colors of ink, such as cyan, magenta, yellow, and black ink in this embodiment, are also mounted on the carriage 15. One end of a flexible ink tube 17*a* to 17*d* is connected to each ink pump 16*a* to 16*d*. The other ends of the flexible ink tubes 17*a* to 17*d* are respectively connected to four ink supply paths (not shown in the figure) that extend vertically and are located at a position on the back end side of the ink cartridge loading unit 8. Each of the ink supply paths communicates with the side of an ink cartridge 9 in the ink cartridge loading unit 8. Ink sacks storing the cyan, magenta, yellow, and black inks are stored in the ink cartridge 9, and the different colors of ink stored in the ink sacks are supplied through the flexible ink tubes 17*a* to 17*d* to the ink pumps 16*a* to 16*d*. The ink supplied to the ink pumps 16*a* to 16*d* is then supplied to the inkjet head 14.

A head maintenance unit 20 is rendered at a position on the right side of the roll paper compartment 12. When the carriage 15 is at the home position 15A, the nozzle surface 14*a* of the inkjet head 14 carried on the carriage 15 is above and opposite the head maintenance unit 20. The head maintenance unit 20 is described in detail below.

During normal printing operations, the inkjet printer 1 conveys recording paper delivered from roll paper stored in the roll paper compartment 12 over the surface of the platen 13 to the recording paper exit 6 by means of a transportation mechanism not shown, and prints on the recording paper by moving the inkjet head 14 reciprocally left and right synchronized to conveyance of the recording paper.

Head Maintenance Unit

Figure 3:
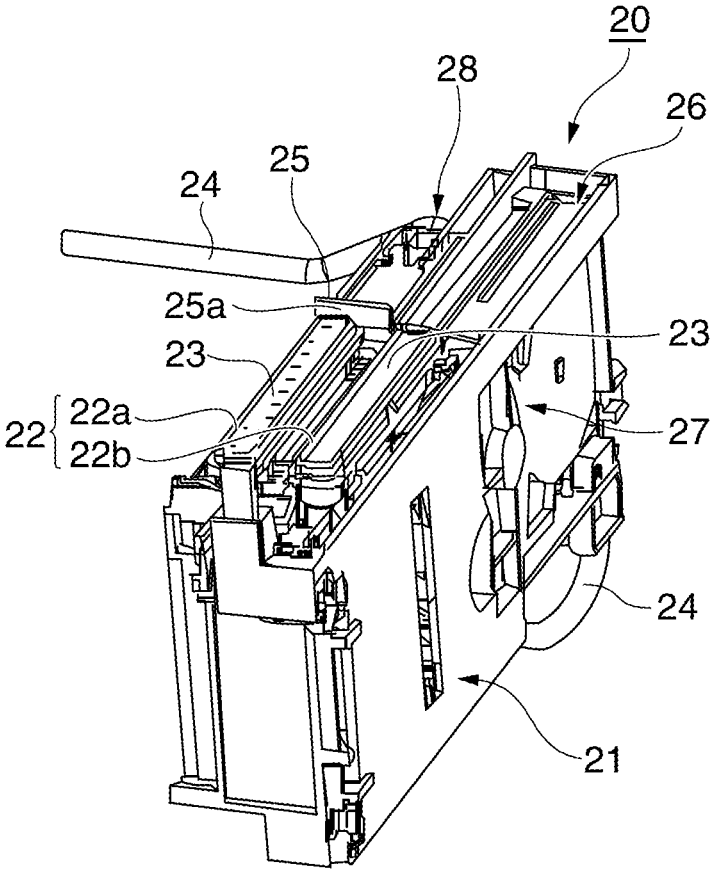
FIG. 3 is an oblique view of the head maintenance unit.
Figure 6:
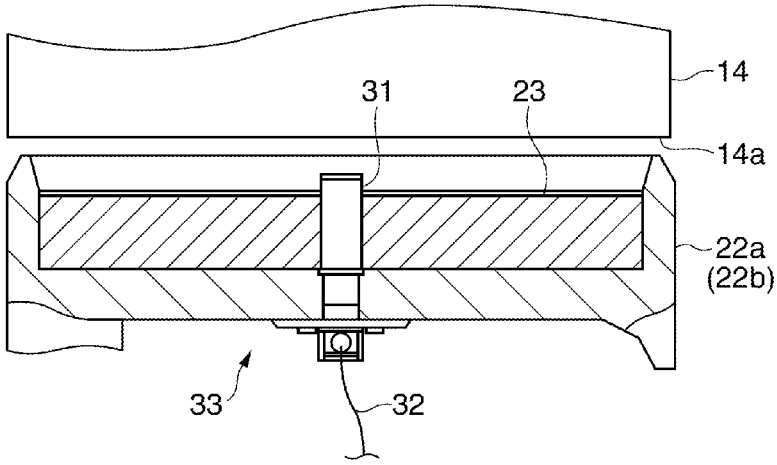
FIG. 6 shows the relationship between the inkjet head and the head cap during the ink droplet ejection test.

FIG. 3 is an oblique view of the head maintenance unit 20. FIG. 4A shows the relationship between the inkjet head 14 and the head caps 22*a*, 22*b* during the flushing operation, and FIG. 4B shows the relationship between the inkjet head 14 and the head caps 22*a*, 22*b* during the ink suction operation. FIG. 5 shows the relationship between the inkjet head 14 and the head wiper 25 during the wiping operation. FIG. 6 shows the relationship between the inkjet head 14 and the head caps 22*a*, 22*b* during the ink droplet ejection test.

As shown in FIG. 3, the head maintenance unit 20 has a rectangular box-like unit case 21 that is long in the front-back direction of the printer. A head cap unit 22 with two head caps 22*a*, 22*b* is disposed at the top of the front part of the unit case 21. The head caps 22*a*, 22*b* are adjacent to each other in the carriage scanning direction. The tops of the head caps 22*a*, 22*b* are open, and these openings are opposite the nozzle surface 14*a* of the inkjet head 14. An ink absorber 23 is disposed inside the head caps 22*a*, 22*b*. As shown in FIG. 4, the inkjet head 14 of the inkjet printer 1 according to this embodiment of the invention includes a pair of inkjet heads 14A and 14B disposed side by side in the carriage scanning direction.

A head cap elevator (not shown in the figure) that raises and lowers the head caps 22*a*, 22*b* is disposed below the head cap unit 22. A tube pump (not shown in the figure) and tube pump drive motor (not shown in the figure) are disposed to the unit case 21 behind the head cap elevator.

An ink suction operation that suctions ink from each of the ink nozzles by means of a tube pump is performed at capping position 22A where the nozzle surface 14*a* of the inkjet head 14 is capped by the head caps 22*a*, 22*b* from below as shown in FIG. 4B. The waste ink that is removed by this ink suction operation is sent through a waste ink tube 24 by the tube pump. This waste ink tube 24 communicates with the ink cartridge 9 stored in the ink cartridge loading unit 8, and the waste ink is recovered into a waste ink storage unit in the ink cartridge 9.

A flushing operation that ejects a specific amount of ink droplets from each nozzle toward the ink absorber 23 is performed at the capping position 22B where the head caps 22*a*, 22*b* are retracted down from the capping position 22A as shown in FIG. 4A. A suction mechanism 29 (see FIG. 7) that suctions ink (fluid) from the ink nozzles is rendered in this embodiment of the invention by the head cap unit 22, the tube pump, and the tube pump drive motor, for example.

The head maintenance unit 20 includes a wiping mechanism 26 that has a head wiper 25 for wiping excess ink, paper dust, and other foreign matter from the nozzle surface 14*a* of the inkjet head 14. The head wiper 25 is a thin, flat, rectangular member made of rubber or other flexible material, and is disposed to the unit case 21 behind the head cap unit 22. The side of the head wiper 25 is the wiping surface 25*a* that wipes ink from the nozzle surface 14*a*. Felt, sponge, or other fluid absorber that absorbs the ink that clings to the head wiper 25 when ink is wiped from the nozzle surface 14*a* is disposed on both front and back sides of the head wiper 25. A head wiper drive mechanism 27 that moves the head wiper 25 bidirectionally front and back is also connected to the head wiper 25.

The head wiper drive mechanism 27 includes a rack formed extending front-back on the back of the wiper case 28 that extends front-back and holds the head wiper 25, a pinion that meshes with the rack, and a gear train that transfers torque from the drive source to the pinion. In this embodiment of the invention the drive source of the head wiper drive mechanism 27 is a motor for driving the tube pump.

The head wiper 25 can move bidirectionally in the front-back direction of the printer along the top end of the unit case 21 of the head maintenance unit 20. When the inkjet head 14 is in the home position 15A and the head wiper 25 moves to the front from the back of the head cap unit 22, the head wiper 25 slides across the nozzle surface 14*a* of the pair of inkjet heads 14A and 14B while bending back, thereby wiping the nozzle surface 14*a* in the wiping operation.

The head maintenance unit 20 in this embodiment of the invention also has a function for testing for dropped dots or missing dots resulting from any of the plural ink nozzles of the inkjet head 14 not discharging ink droplets (that is, testing for any clogged ink nozzles).

As shown in FIG. 6, a metal rod 31 is disposed conductively to the ink absorber 23 inside each of the head caps 22*a*, 22*b*, and a lead 32 is connected to the bottom end of the metal rod 31. When charged ink is discharged from an ink nozzle of the inkjet head 14 and the charged ink droplets land on the ink absorber 23, a change occurs in the current extracted from the metal rod 31 and lead 32. Whether or not ink droplets are being discharged from the ink nozzles can be determined based on the change in this current. The head maintenance unit 20 performs an ink droplet ejection test to test for dropped dots based on change in the current thus extracted from the metal rod 31 and lead 32. An ink droplet ejection test mechanism (fluid droplet ejection test mechanism) 33 that tests for dropped dots is rendered by means of the ink absorber 23, metal rod 31, and lead 32 in this embodiment of the invention.

Control Unit Configuration

Figure 7:
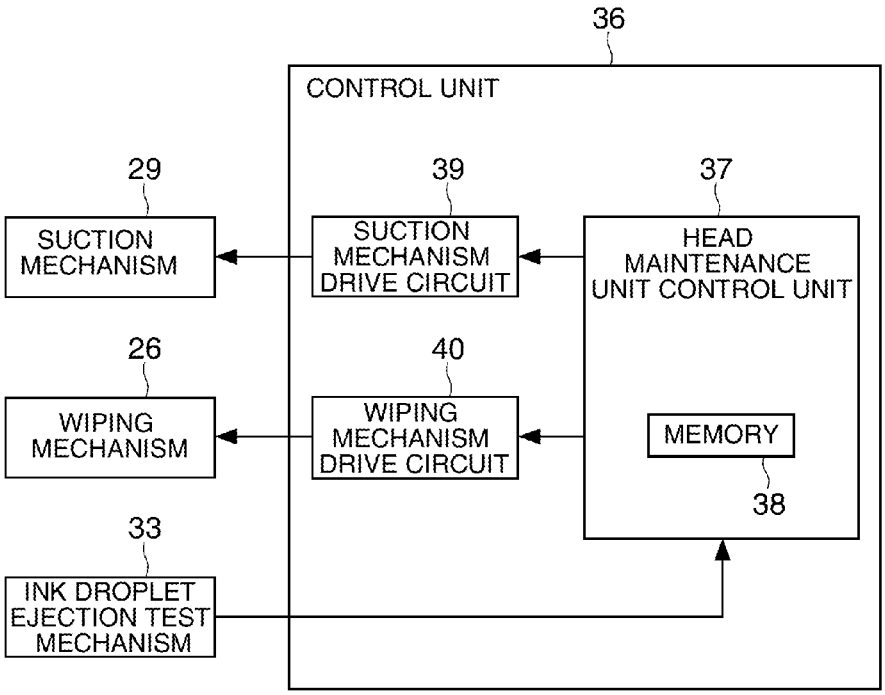
FIG. 7 is a block diagram showing part of the control unit of the inkjet printer.

FIG. 7 is a block diagram showing part of the control unit 36 of the inkjet printer 1. The control unit 36 of the inkjet printer 1 includes a head maintenance unit control unit 37 for controlling the head maintenance unit 20. The head maintenance unit control unit 37 includes memory 38 such as ROM or RAM, and a CPU (not shown in the figure). The ink droplet ejection test mechanism 33 is connected to the head maintenance unit control unit 37, and the head maintenance unit control unit 37 determines if there are dropped dots based on change in the current read from the metal rod 31 and lead 32.

A suction mechanism drive circuit 39 that drives the suction mechanism 29, and a wiping mechanism drive circuit 40 that drives the wiping mechanism 26, are also connected to the head maintenance unit control unit 37. The suction mechanism drive circuit 39 is a circuit for driving the tube pump drive motor, for example. The wiping mechanism drive circuit 40 is a circuit for driving the head wiper drive mechanism 27.

Ink Droplet Ejection Test and Dropped Dot Elimination Operation

Figure 8:
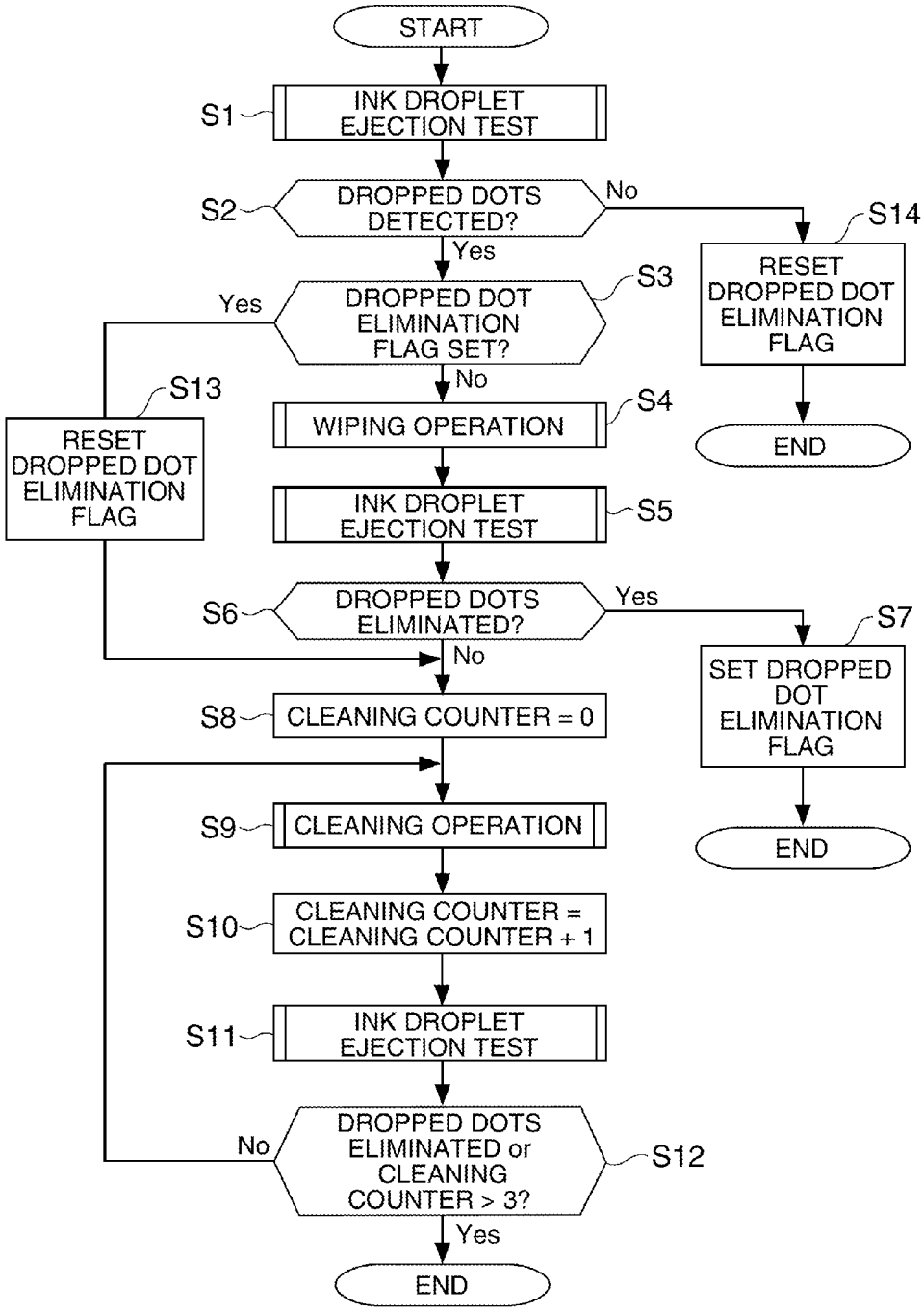
FIG. 8 is a flow chart of the ink droplet ejection test and the operation for eliminating dropped dots.

FIG. 8 is a flow chart of the ink droplet ejection test and the operation for eliminating dropped dots or missing dots. The inkjet printer 1 runs an ink droplet ejection test at the home position 15A every time a specific number of pages of recording paper are printed. If the ink droplet ejection test determines that dots are being dropped because of a faulty nozzle, the dropped dots are eliminated by executing either or both the ink suction cleaning operation of the inkjet head 14 and the wiping operation. The ink droplet ejection test and the operation for eliminating dropped dots are described next with reference to FIG. 8.

When printing a specific number of pages of recording paper is completed, the control unit 36 discharges charged ink droplets from the ink nozzles of the inkjet head 14 at the home position 15A and performs the ink droplet ejection test (step S1). The head maintenance unit control unit 37 then determines if there are any dropped dots (step S2).

If dropped dots are detected in step S2, the head maintenance unit control unit 37 determines if a history of eliminating dropped dots by means of the wiping operation remains (step S3). More specifically, in step S3 the head maintenance unit control unit 37 determines if a history of eliminating dropped dots by means of the wiping operation is stored in memory 38. Yet more specifically, in step S3 the head maintenance unit control unit 37 determines if a dropped dot elimination flag remains set in the memory 38. This dropped dot elimination flag is set in memory 38 in step S7 once dropped dots have been eliminated as described below.

If in step S3 it is determined that the dropped dot elimination flag in memory 38 was reset (that is, a history of eliminating dropped dots by means of a wiping operation does not remain in memory 38), the head maintenance unit control unit 37 controls the wiping mechanism drive circuit 40 and drives the wiping mechanism 26 to execute the wiping operation in order to eliminate dropped dots (step S4). After the wiping operation is completed, the control unit 36 executes the ink droplet ejection test (step S5), and the head maintenance unit control unit 37 then determines if the dropped dots were eliminated by the wiping operation performed in step S5 (step S6).

If it is determined in step S6 that the dropped dots were eliminated, the head maintenance unit control unit 37 sets the dropped dot elimination flag in memory 38 to store information indicating that dropped dots were eliminated by the wiping operation (step S7). Once the dropped dot elimination flag is set in memory 38, the ink droplet ejection test and dropped dot elimination operation end normally.

However, if it is determined in step S6 that the dropped dots were not eliminated, the head maintenance unit control unit 37 resets a cleaning counter in memory 38 to 0 (step S8), and then controls the suction mechanism drive circuit 39 to drive the suction mechanism 29 and perform the cleaning operation (step S9). The head maintenance unit control unit 37 then adds 1 to the current cleaning count to update the cleaning counter, and stores the updated cleaning counter in memory 38 (step S10). The control unit 36 then runs the ink droplet ejection test (step S11).

The head maintenance unit control unit 37 then determines if the dropped dots were eliminated by the cleaning operation performed in step S9 (step S12). In step S12 the head maintenance unit control unit 37 determines if the cleaning counter stored in memory 38 exceeds a specific value (such as 3). The head maintenance unit control unit 37 thus determines if the cleaning operation has been performed a specific number of times.

If the dropped dots were not eliminated or the cleaning count exceeds the preset limit in step S12, control returns to step S9 and the cleaning operation repeats. If in step S12 the dropped dots were eliminated, the ink droplet ejection test and dropped dot elimination operation end normally.

If the dropped dots were not eliminated and the cleaning count exceeds the preset limit in step S12, a warning is returned to the host device (not shown in the figure) of the inkjet printer 1 and the ink droplet ejection test and dropped dot elimination operation end.

If in step S3 the dropped dot elimination flag remains set in memory 38 (that is, a history of eliminating dropped dots by a wiping operation remains in memory 38), the head maintenance unit control unit 37 resets the dropped dot elimination flag in memory 38 (step S13) and control goes to step S8. More specifically, the head maintenance unit control unit 37 deletes the history of eliminating dropped dots by a wiping operation from memory 38 in step S13, and then proceeds to step S8. As a result, if the dropped dot elimination flag is determined in step S3 to be set in memory 38, the head maintenance unit control unit 37 runs the cleaning operation without executing the wiping operation.

In addition, if dropped dots are not detected in step S2, the head maintenance unit control unit 37 resets the dropped dot elimination flag in memory 38 (step S14). More specifically, the head maintenance unit control unit 37 deletes the history of eliminating dropped dots by a wiping operation from memory 38 in step S14. If the dropped dot elimination flag is reset in memory 38, the ink droplet ejection test and dropped dot elimination operation end normally.

In this embodiment of the invention steps S1 and S2 are the dropped dot detection step, step S3 is the elimination history detection step, step S4 is the wiping step, and step S9 executed through step S13 is the cleaning step in the accompanying claims.

In addition, steps S5 and S6 are a second dropped dot detection step, step S7 is a set dropped dot elimination flag step, step S13 is a reset dropped dot elimination flag step, and step S14 is a second reset dropped dot elimination flag step.

Note, further, that memory 38 in this embodiment of the invention is a storage unit for storing a history of dropped dot elimination by means of a wiping operation. The suction mechanism drive circuit 39 and wiping mechanism drive circuit 40 drive the wiping mechanism 26 if the elimination history does not remain in the storage unit when dropped dots are detected, and drive the suction mechanism drive circuit 39 if the elimination history remains.

Effect of the Invention

As described above, when dropped dots are detected, this embodiment of the invention executes a wiping operation if a history of eliminating dropped dots by means of a wiping operation does not remain in memory 38. As a result, dropped dots can be eliminated and consumption of ink droplets discharged from the ink nozzles can be reduced by using a wiping operation. However, if a history of eliminating dropped dots by means of a wiping operation remains in memory 38, this embodiment of the invention runs a cleaning operation without performing the wiping operation. As a result, a wiping operation can be used to eliminate dropped dots while problems that can result from a wiping operation as described above can be solved. In addition, if it is determined in step S6 that dropped dots have not been eliminated, this embodiment of the invention performs the cleaning operation up to a specified number of times until the dropped dots are eliminated. As a result, dropped dots can be reliably eliminated.

When it is determined in step S6 that dropped dots have been eliminated, this embodiment of the invention sets a dropped dot elimination flag in memory 38 in step S7. As a result, whether the history of eliminating dropped dots by means of a wiping operation remains in memory the next time dropped dots are detected can be determined by checking in step S3 if the dropped dot elimination flag is set in memory 38.

If dropped dots are not detected in step S2 in this embodiment of the invention, the dropped dot elimination flag is reset in memory 38 in step S14. As a result, if dropped dots are actually eliminated by the wiping operation, the wiping operation is first performed the next time dropped dots are detected. This configuration reduces consumption of ink droplets discharged from the ink nozzles when compared with a configuration that runs the cleaning operation without a wiping operation the next time dropped dots are detected because the history of eliminating dropped dots by means of a wiping operation is still in memory even though dropped dots were actually eliminated by a previous wiping operation.

Other Embodiments

When a history of eliminating dropped dots by means of a wiping operation is found in memory 38 in step S3, the foregoing embodiment of the invention proceeds through step S13 to step S8. However, when a history of eliminating dropped dots by means of a wiping operation is found in memory 38 in step S3, control may go directly to step S8. In this configuration step S13 is executed after any one of steps S8 to S12.

When dropped dots are not detected in step S2 in the foregoing embodiment, the dropped dot elimination flag is reset in memory 38, and the ink droplet ejection test and dropped dot elimination operation end. However, when dropped dots are not detected in step S2, the ink droplet ejection test and dropped dot elimination operation may be ended without resetting the dropped dot elimination flag.

A preferred embodiment of a fluid ejection device according to the invention is described above using an inkjet printer 1 by way of example, but the fluid ejection device of the invention is not so limited and includes, for example, fluid ejection devices having a fluid ejection head that discharges fluids from nozzles to deposit electrode materials and coloring agents used to form electrodes in liquid crystal display devices, organic EL displays, and FED (field emission display) devices; fluid ejection devices having a fluid ejection head for discharging biomedical materials used in biochip manufacture from nozzles; and fluid ejection devices having a fluid ejection head for discharging reagents from nozzles used as micro-pipettes.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A control method for a fluid ejection device that performs, at home position, at least one of a cleaning operation that suctions fluid from a plurality of nozzles and a wiping operation that wipes a nozzle surface in which the plurality of nozzles are disposed when missing dots result from one or more of the plurality of nozzles for ejecting fluid not ejecting fluid droplets, comprising:

a missing dot detection step that tests for missing dots and determines if missing dots occur;

an elimination history detection step that, when the missing dot detection step determines there are missing dots, determines if a history of eliminating missing dots by means of the wiping operation remains;

a wiping step that performs the wiping operation when the elimination history detection step determines the elimination history does not remain; and a cleaning step that performs the cleaning operation without performing the wiping operation when the elimination history detection step determines the elimination history remains.

2. The control method for a fluid ejection device described in claim 1, further comprising:

a second missing dot detection step that tests for missing dots and determines if missing dots occur after the wiping step;

wherein the cleaning operation is performed if the second missing dot detection step determines missing dots have not been eliminated.

3. The control method for a fluid ejection device described in claim 1, further comprising:

a second missing dot detection step that tests for missing dots and determines if missing dots occur after the wiping step; and a set missing dot elimination flag step that sets a missing dot elimination flag when the second missing dot detection step determines that missing dots were eliminated;

wherein the next time that missing dots occur, the elimination history detection step determines whether or not the elimination history remains by determining if the missing dot elimination flag is set.

4. The control method for a fluid ejection device described in claim 3, further comprising:

a reset missing dot elimination flag step that resets the missing dot elimination flag when the elimination history detection step determines that the missing dot elimination flag is set;

wherein the cleaning step is executed after the reset missing dot elimination flag step.

5. The control method for a fluid ejection device described in claim 4, further comprising:

a second reset missing dot elimination flag step that resets the missing dot elimination flag when the missing dot detection step determines there are no missing dots.

6. A fluid ejection device comprising:

a fluid ejection head having a plurality of nozzles for ejecting fluid droplets;

a fluid droplet ejection test mechanism that tests for the presence of missing dots caused by one or more of the plurality of nozzles not ejecting fluid droplets;

a suction mechanism that suctions fluid from the plurality of nozzles;

a wiping mechanism that wipes a nozzle surface of the fluid ejection head in which the plurality of nozzles are disposed while the fluid ejection head is at home position;

a storage unit configured to store a history of eliminating missing dots by a wiping operation of the wiping mechanism; and a head maintenance unit control unit that determines if the missing dot elimination history remains in the storage unit, and when missing dots are detected, drives the wiping mechanism if the elimination history does not remain in the storage unit, and drives the suction mechanism if the elimination history remains in the storage unit.

7. The fluid ejection device described in claim 6, wherein:

the head maintenance unit control unit performs a second missing dot detection operation that causes the fluid droplet ejection test mechanism to test for missing dots after the wiping operation is performed and determine if missing dots were eliminated by the wiping operation, and if missing dots were not eliminated causes the suction mechanism to perform the suction.

8. The fluid ejection device described in claim 6, wherein:

the fluid ejection head is an inkjet head having the plurality of nozzles for ejecting ink.

9. The fluid ejection device described in claim 7, wherein:

the head maintenance unit control unit sets a missing dot elimination flag in the storage unit if elimination of missing dots is confirmed in the second missing dot detection operation.

10. The fluid ejection device described in claim 9, wherein:

when the missing dot elimination flag is set, the head maintenance unit control unit resets the missing dot elimination flag, and after resetting the missing dot elimination flag causes the suction mechanism to perform the suction.

* * * * *